United States Patent [19]

Nizamoff

[11] 4,222,844

[45] Sep. 16, 1980

[54] USE OF ONCE-THROUGH TREAT GAS TO REMOVE THE HEAT OF REACTION IN SOLVENT HYDROGENATION PROCESSES

[75] Inventor: Alan J. Nizamoff, Convent Station, N.J.

[73] Assignee: Exxon Research & Engineering Co., Florham Park, N.J.

[21] Appl. No.: 904,096

[22] Filed: May 8, 1978

[51] Int. Cl.[2] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,583,900 | 6/1971 | Gatsis | 208/8 LE |
| 3,617,465 | 11/1971 | Wolk | 208/8 LE |
| 4,045,328 | 8/1977 | Green et al. | 208/8 LE |

*Primary Examiner*—Delbert E. Gantz
*Assistant Examiner*—William G. Wright
*Attorney, Agent, or Firm*—Wayne Hoover

[57] ABSTRACT

In a coal liquefaction process wherein feed coal is contacted with molecular hydrogen and a hydrogen-donor solvent in a liquefaction zone to form coal liquids and vapors and coal liquids in the solvent boiling range are thereafter hydrogenated to produce recycle solvent and liquid products, the improvement which comprises separating the effluent from the liquefaction zone into a hot vapor stream and a liquid stream; cooling the entire hot vapor stream sufficiently to condense vaporized liquid hydrocarbons; separating condensed liquid hydrocarbons from the cooled vapor; fractionating the liquid stream to produce coal liquids in the solvent boiling range; dividing the cooled vapor into at least two streams; passing the cooling vapors from one of the streams, the coal liquids in the solvent boiling range, and makeup hydrogen to a solvent hydrogenation zone, catalytically hydrogenating the coal liquids in the solvent boiling range and quenching the hydrogenation zone with cooled vapors from the other cooled vapor stream.

4 Claims, 1 Drawing Figure

USE OF ONCE-THROUGH TREAT GAS TO REMOVE THE HEAT OF REACTION IN SOLVENT HYDROGENATION PROCESSES

The Government of the United States of America has rights in this invention pursuant to Contract No. EF-77-A-01-2893 awarded by the U.S. Energy Research and Development Administration.

BACKGROUND OF THE INVENTION

1. Field of the Invention

This invention relates to coal liquefaction and is particularly concerned with integrated liquefaction processes in which coal liquids produced by the treatment of feed coal with molecular hydrogen and a hydrogen-donor solvent are subsequently hydrogenated for the production of recycle solvent and, optionally, additional liquid products.

2. Description of the Prior Art

Among the more promising processes for the production of liquid hydrocarbons from coal are those in which the feed coal is first contacted with molecular hydrogen and a hydrogen-donor solvent in a liquefaction zone at elevated temperature and pressure and a portion of the liquid product is then catalytically hydrogenated in a solvent hydrogenation zone to generate solvent for recycle to the liquefaction step and produce additional liquid products. Hydrogenation of the liquid in the solvent boiling range is generally carried out at a pressure similar to or somewhat lower than that employed in the liquefaction zone and at a somewhat lower temperature. To supply the heat required to raise the solvent boiling range liquid to the hydrogenation temperature, it has been proposed that all of the vaporous product taken overhead from the liquefaction zone be passed directly to the solvent hydrogenation zone without cooling and that the quantity of coal liquids are recycle hydrogen which is mixed with the vaporous product and fed to the hydrogenation zone be adjusted so that the combined feed stream is maintained at the required hydrogenation temperature. This eliminates the need for a furnace to preheat the feed stream. Because the hydrogenation reaction is exothermic, additional cold feed is introduced into the hydrogenation zone downstream of the initial inlet point to quench the reaction and at the same time heat this additional feed to the necessary hydrogenation temperature.

Although the process described above has advantages over earlier processes from the standpoint of conserving thermal energy, it poses certain operational problems which tend, at least in part, to offset the heat conservation advantages. The use of the liquefaction vapors to provide all of the heat needed to raise the initial increment of the liquid feed to the hydrogenation temperature and thus eliminate the need for a furnace limits the ratio in which liquid and vapor can be introduced into the initial stage of the hydrogenation zone and imposes restrictions with respect to the hydrogen partial pressure in the initial stage. In addition, the cold feed introduced downstream of the initial stage has a relatively short residence time within the hydrogenation zone and hence uniform hydrogenation to achieve maximum solvent and product yields may be difficult to obtain. Overhydrogenation may sometimes occur. Moreover, the introduction of relatively cold feed into the reaction zone at one or more points downstream of the initial inlet makes effective contacting of the feed and hydrogen more difficult to achieve, may promote product degradation and the production of excessive quantitues of gas and low molecular weight hydrocarbons, and makes the overall reaction difficult to control. As a result of these and related disadvantages, the overall efficiency of such a process may leave much to be desired.

More recently, and in an effort to avoid the operating problems associated with the process described above, it has been proposed to cool the gaseous product from the liquefaction reactor so as to recover additional liquids therefrom and to effectively operate the hydrogenation portion of the process separately from the liquefaction portion thereof. In this method of operation, the vapor from the liquefaction step is, generally, cooled to recover additional liquid therefrom and then combined with makeup hydrogen and used as a "treat-gas" in the hydrogenation step of the process. Also, in this method of operation, the feed to the hydrogenation zone is, generally, preheated and the hydrogenation reaction quenched by recycling cooled liquid and/or gas from the hydrogenation zone. For reasons believed readily apparent, this method of operation avoids the "operational" problems associated with the previously described process. The recycle of vapor and/or liquid from the hydrogenation zone, however, increases the equipment requirements since additional pumps and/or compressors, heat exchangers, etc., will be required. Also, especially when vapors are recycled, additional processing steps are required since hydrogenation catalyst poisons must be removed from the recycle stream. As a result, the initial investment and the continuing operating costs are increased when this particular method is used. Moreover, since the number of processing steps is increased, process control and operation is, generally, more complicated. The need, then, for a process offering the operational advantages associated with separate control of both the liquefaction and hydrogenation sections without the increased equipment requirements and processing steps is believed to be readily apparent.

SUMMARY OF THE INVENTION

It has now been found that the foregoing disadvantages of the prior art liquefaction processes can be avoided while retaining the advantages associated with separate operation of the liquefaction and hydrogenation sections with the improved method of this invention. Accordingly, it is the object of this invention to provide an improved liquefaction process for solid carbonaceous materials. It is still another object of this invention to provide such a process wherein the hydrogenation reaction is quenched without recycling either liquid or vapor from the hydrogenation zone for this purpose. These and other objects and advantages will become more apparent from the description set forth hereinafter and from the figures attached thereto.

In accordance with the invention, hydrogenated liquid products are produced from bituminous coal, subbituminous coal, lignite and similar feed materials by first treating the coal or other solid feed material at elevated temperature and pressure with molecular hydrogen and a hydrogen-donor solvent in a noncatalytic liquefaction zone, separating the overhead effluent from the liquefaction zone into a vapor stream and a liquid stream, separating the vapor stream into at least two portions and then using one portion thereof as a treat-gas in a hydrogenation zone and another portion thereof to quench the hydrogenation reaction. Prior to separation, the vapor stream will be treated to remove contaminants and/or hydrogenation catalyst poisons such as ammonia, hydrogen chloride, hydrogen sulfide, carbon monoxide and the like. Also, that portion of the vapor, which is subsequently used as a treat-gas in the hydrogenation zone, will, generally, be combined with "makeup" hydrogen prior to introduction into the hydrogenation zone.

BRIEF DESCRIPTION OF THE DRAWING

The FIGURE is a schematic flow diagram of a process carried out in accordance with the invention for the production of hydrogenated liquid products from coal with a gaseous quench.

DETAILED DESCRIPTION OF THE INVENTION

Figure 1:
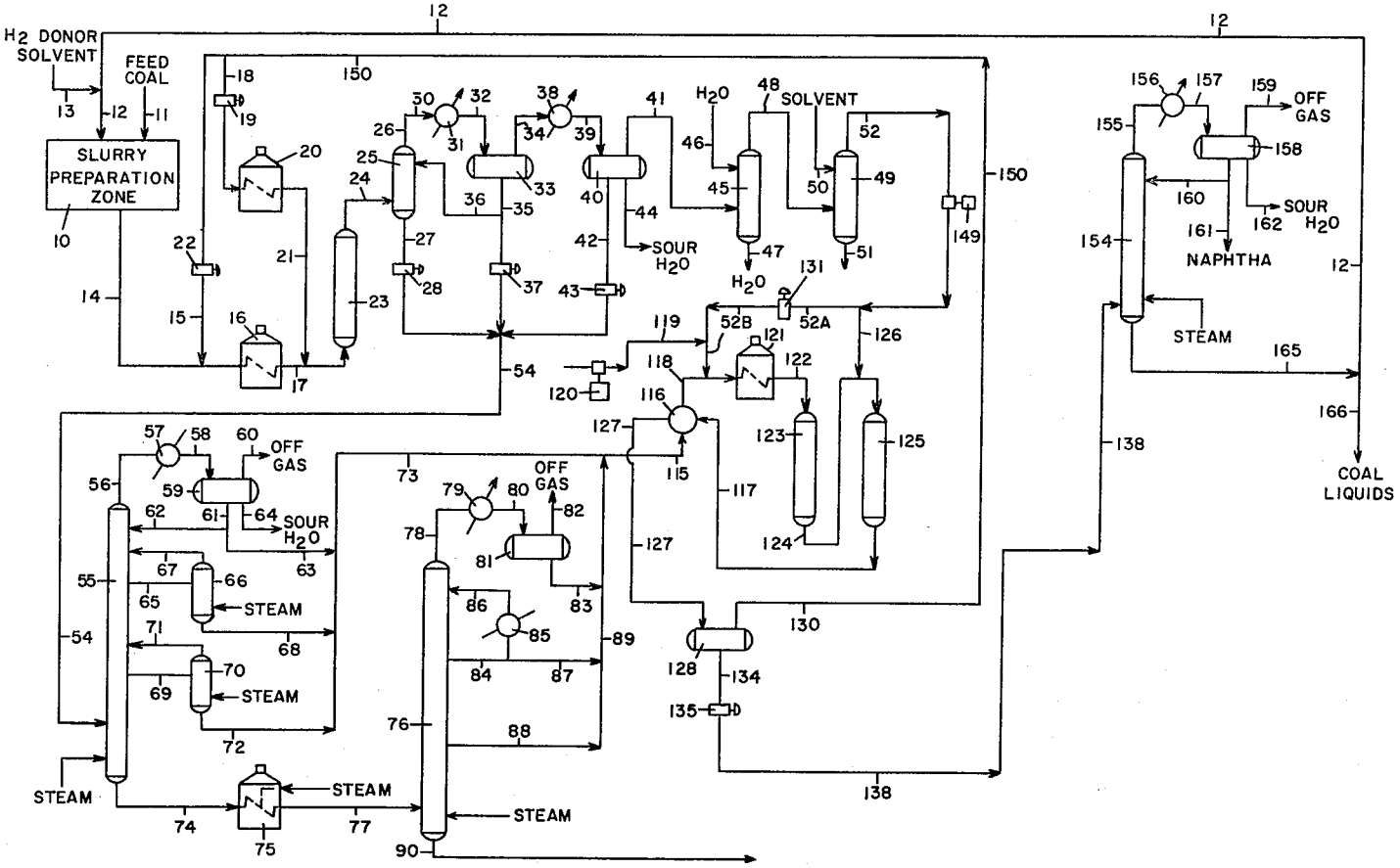

As indicated supra, the present invention relates to an improved process for the liquefaction of solid carbonaceous materials such as bituminous and subbituminous coals, lignite, coke and the like. The liquefaction is accomplished at an elevated temperature and pressure in the presence of a hydrogen-donor solvent and molecular hydrogen. As also indicated supra, the liquefaction reactions generally result in the formation of liquid product as well as gaseous product and a bottoms product. After liquefaction, the gaseous or vapor product is, generally, separated from the liquid and bottoms products by flashing. Both the vapor product and the combined liquid and bottoms products may be subject to additional treatments to effect further purification and/or separation.

In general, any of the techniques known in the prior art can be used to separate the liquid and bottoms products. Such methods include filtration, simple flashing and distillation. Of these, distillation, either alone or in combination with one or more other techniques is preferred since this method permits separation of that portion of the liquid product which will be hydrogenated and then used as the hydrogen-donor solvent.

When distillation is used, the liquid stream recovered from the liquefaction zone effluent will be fractionated to produce a gaseous fraction, a distillate fraction including constituents within the donor-solvent boiling range, and a bottoms fraction boiling in excess of about 1000° F. The distillate fraction and particularly the solvent fraction can be preheated by indirect heat exchange with the effluent from the solvent hydrogenation zone and then mixed with vapor from the liquefaction zone and makeup hydrogen before it is used as solvent hydrogenation feed. The mixed solvent hydrogenation feed stream thus prepared may be passed through a preheat furnace and heated to the hydrogenation reaction temperature if needed. Only a relatively small increase in temperature is generally needed at this point and hence in most cases the preheat furnace can be dispensed with. The heavy 1000° F.+ bottoms product recovered from the liquefaction zone effluent is passed through a coking zone or the like for upgrading into more valuable products.

The solvent hydrogenation feed prepared as described above is introduced into the solvent hydrogenation zone, preferably a multistage reaction provided with means for introducing a quench between stages, and hydrogenation takes place in the presence of a hydrogenation catalyst. The effluent from this hydrogenation zone can be passed in indirect heat exchange with the distillate containing solvent boiling range constituents and then separated, preferably at hydrogenation pressure, into a vapor fraction composed primarily of hydrogen and normally gaseous hydrocarbons and a liquid fraction. The vapor is recycled for introduction into the coal-solvent slurry fed to the liquefaction zone. The liquid stream separated from the hydrogenation zone effluent, if not previously fractionated to the extent desired, can be further fractionated to produce overhead gases and naphtha and a heavier fraction. The remainder of the heavier fraction is recycled to the slurry preparation zone as donor solvent or withdrawn as product.

The vapor stream withdrawn from the liquefaction zone will, generally, be passed through one or more gas-liquid separators to separate entrained liquids therefrom. Such separation will, of course, be facilitated by cooling and when a series of separators is employed, the vapor will generally, be cooled after passing through each of the separators in the series. This vapor stream will, generally, also be treated to remove impurities and hydrogenation catalyst poisons.

After cooling and purification, a portion of the vapor may be withdrawn as gaseous product. The remainder will then be used as a treat-gas in the hydrogenation zone and to quench the hydrogenation reaction. This will, generally, be accomplished by splitting the vapor stream into a first portion to be used as the treat-gas and as many remaining portions as may be required to effect the desired quenching. In this regard, it should be noted that when a single hydrogenation zone or stage is employed, the quench gas may be injected through one or more points disposed along said zone or stage and, generally, will be injected at or near the outlet from said zone or stage. When a plurality of zones or stages is employed, a portion of the quench gas will, generally, be injected into the effluent from each zone or stage.

In general, the amount of quench gas required for each zone or stage will depend upon the inlet temperature to that stage or zone, the extent of the hydrogenation completed therein and the total volume of liquid passed therethrough. Effective quenching will, however, generally be obtained when from about 1.5 to about 2.5 SCM of quench gas at a temperature between about 100° and 200° F. is used per SCM of liquid subjected to hydrogenation in each stage or zone.

The process of the invention has advantages over earlier processes in that it results in better heat integration of the liquefaction and solvent hydrogenation steps of the process, reduces the number of recycle steps which must be employed, alleviates difficulties that might otherwise be encountered as a result of the nonuniform hydrogenation of coal liquids produced in the liquefaction zone, reduces the likelihood of hydrocracking and other undesirable reactions in the hydrogenation zone, simplifies process control problems, permits greater process flexibility, and has other benefits. As a result of these advantages, the process of the invention may have widespread application.

DESCRIPTION OF THE PREFERRED EMBODIMENTS

Having thus broadly described the invention, it is believed that the same will become even more apparent from the following description of particularly preferred embodiments by reference to the attached FIGURE. Referring then to the FIGURE, a preferred embodiment includes a slurry preparation zone 10 into which feed coal is introduced through line 11 from a coal storage or feed preparation zone not shown in the drawing and combined with a preheated hydrogen-donor solvent introduced through line 12 to form a slurry. The coal employed will normally consist of solid particles of bituminous coal, subbituminous coal, lignite or a mixture of two or more such materials having a particle size on the order of about one-fourth inch or larger along the major dimension. It is generally preferred to crush and screen the feed coal to a particle size of about 8 mesh or smaller on the U.S. Sieve Series Scale and to dry the feed coal particles to remove excess water, either by conventional techniques before the solids are mixed with the solvent in the slurry preparation zone or by mixing the wet solids with hot solvent at a temperature above the boiling point of water, preferably between about 250° F. and about 350° F. to vaporize any excess water present. The moisture in the feed slurry will preferably be reduced to less than about 2 weight percent. The hydrogen-donor solvent required for initial startup of the process and any makeup solvent that may be needed can be added to the system through line 13. The process of the invention normally produces an excess of liquid hydrocarbons in the donor solvent boiling range and hence the addition of makeup solvent is generally unnecessary. Solvent will therefore normally be fed through line 13 for startup purposes only. The hydrogen-donor solvent employed to prepare the coal-solvent slurry will normally be a coal-derived solvent, preferably a hydrogenated recycle solvent containing at least 20 weight percent of compounds which are recognized as hydrogen donors at the elevated temperatures of from 700° F. to about 900° F. which are generally employed in coal liquefaction operations. Solvents containing at least 50 weight percent of such compounds are preferred. Representative compounds of this type include indane, $C_{10}$–$C_{12}$ tetrahydronaphthalenes, $C_{12}$ and $C_{13}$ acenaphthenes, di-, tetra-, and octahydroanthracenes, tetrahydroacenaphthenes, crysene, phenanthrene, pyrene and other derivatives of partially saturated aromatic compounds. Such solvents have been described in the literature and will be familiar to those skilled in the art. The solvent composition produced by the hydrogenation of hydrocarbons produced in the process will depend in part upon the particular coal used as the feedstock to the process, the process steps and operating conditions employed for liquefaction of the coal, the particular boiling range fraction selected for hydrogenation, and the hydrogenation conditions employed within the hydrogenation zone. In the slurry preparation zone 10, the incoming feed coal is normally mixed with solvent recycle through line 12 in a solvent-to-coal ratio of from about 0.8:1 to about 10:1. Ratios of from about 1:1 to about 1.7:1 are in most cases preferred.

The slurry of coal and solvent which is prepared in zone 10 as described above is withdrawn through line 14 and introduced, together with vapor recycled through line 15, into mixed phase preheat furnace 16 where the feed materials are heated to a temperature within the range between about 750° F. and about 950° F. The mixture of hot slurry and vapor withdrawn from the furnace through line 17 will ordinarily contain from about 1 to about 8 weight percent, preferably from about 2 to about 5 weight percent, of molecular hydrogen on a moisture and ash-free basis. In lieu of mixing the slurry and recycle vapor or treat gas prior to preheating in the furnace as described above, the vapor can be passed through line 18 containing valve 19, separately preheated in furnace 20, and thereafter passed through line 21 for addition to the hot slurry in line 17. If this procedure is used, valve 19 will normally be open and valve 22 in line 15 will normally be closed. This use of separate preheat furnaces for the slurry and treat gas has advantages in some cases and is often preferred. If two furnaces are provided, a portion of the recycle vapor or treat gas can be preheated in each of the furnaces if desired.

The hot slurry containing recycle vapor or treat gas is fed from line 17 into liquefaction reactor 23 which is maintained at a temperature between about 750° F. and about 950° F., preferably between about 825° F. and about 875° F. and at a pressure between about 1000 psig and about 3000 psig, preferably between about 1500 and about 2500 psig. A single upflow liquefaction reactor is shown in the drawing but a plurality of reactors arranged in parallel or series can be employed if desired. The liquid residence time within reactor 23 will normally range between about 5 minutes and about 100 minutes and will preferably be from about 10 to about 60 minutes. Within the liquefaction zone, high molecular weight constituents of the coal are broken down and hydrogenated to form lower molecular weight, gaseous, vapor and liquid products. The hydrogen-donor solvent contributes hydrogen atoms which react with organic radicals liberated from the coal and prevent their recombination. The hydrogen in the recycle vapor stream injected with the slurry serves as replacement hydrogen for depleted hydrogen-donor molecules in the solvent and results in the formation of additional donor solvent molecules by in situ hydrogenation. Process conditions within the liquefaction zone are selected to insure the generation of sufficient hydrogen-donor precursors and at the same time provide sufficient liquid product for the proper operation of the solvent hydrogenation zone in the process. The conditions employed in the liquefaction reactor may be varied as necessary to achieve these objectives.

The effluent from liquefaction zone 23 is taken overhead through line 24. This effluent stream will normally include gaseous liquefaction products such as carbon monoxide, carbon dioxide, ammonia, hydrogen, hydrogen chloride, hydrogen sulfide, methane, ethane, ethylene, propane, propylene, naphtha, and the like; unreacted hydrogen from the feed slurry, solvent boiling range hydrocarbons, and heavier liquefaction products including solid liquefaction residues. This stream is passed to reactor effluent separator 25 where it is separated at substantially liquefaction reactor pressure and at a temperature only slightly lower than that in the liquefaction reactor into a hot overhead vapor stream having a temperature of from about 700° F. to about 900° F. which is withdrawn through line 26 and a liquid stream taken off through line 27 containing pressure letdown valve 28. The hot overhead stream passes through line 30 and is subjected to further treatment such as cooling and scrubbing. Also, though not illustrated, a portion of the hot overhead vapor may be withdrawn as gaseous product.

In a most preferred embodiment, the entire hot overhead vapor stream will be withdrawn through line 30 and subjected to cooling and scrubbing prior to a division of this stream. Also, in this embodiment, as illustrated, the vapor stream passed through line 30 enters heat exchanger 31 where it is cooled to a temperature between about 400° F. and about 700° F., preferably between about 500° F. and about 600° F., and then passes through line 32 into hot liquefaction separator 33, still at substantially liquefaction pressure. Gases and vapors are taken off overhead from the hot separator through line 34 and liquids are withdrawn through line 35. A portion of the liquid stream may be returned through line 36 to reactor effluent separator 25 for use as wash oil. The remaining liquid is then discharged through pressure letdown valve 37. When desired, the cooling may be accomplished in a plurality of heat exchangers. When this is done the gases and vapors in line 34 pass through a second heat exchanger 38 where they are further cooled without any substantial reduction in pressure. From the heat exchanger, the gases and vapors flow through line 39 into cold liquefaction separator 40 where a further separation takes place. An overhead stream containing hydrogen, carbon monoxide, carbon dioxide, ammonia, hydrogen chloride, hydrogen sulfide, normally gaseous hydrocarbons, and some naphtha boiling range hydrocarbons is withdrawn through line 41. A liquid stream containing dissolved gases but composed primarily of liquid hydrocarbons boiling below about 700° F. at atmospheric pressure is recovered through line 42 containing pressure letdown valve 43. A sour water stream produced by the condensation of water vapor is withdrawn from separator 40 through line 44.

The gases and vapors recovered from the cold liquefaction separator are passed from line 41 into liquefaction water scrubber 45 where they are contacted with water introduced through line 46 for the removal of ammonia, hydrogen chloride, and other water-soluble constituents. Water containing the dissolved contaminants is withdrawn from the scrubber through line 47 and passed to cleanup facilities not shown in the drawing. The scrubbed gas and vapor is then passed through line 48 into solvent scrubber 49 where it is contacted with monoethanolamine, diethanolamine or a similar solvent introduced through line 50 for the removal of hydrogen sulfide, carbon dioxide and other acid gases. Spent solvent is withdrawn from this scrubber through line 51 and sent to a solvent recovery unit which does not appear in the drawing for the removal of the adsorbed materials and regeneration of the solvent. The scrubber gases are taken overhead through line 52, passed through compressor 149 where it is compressed to solvent hydrogenation stage pressure level, and then divided such that a first portion thereof is passed through line 52A, combined with makeup hydrogen and fed either to the hydrogenation preheat furnace or directly to the hydrogenation zone in a manner more fully described hereinafter, and a second portion thereof is passed through line 126 and used to quench the hydrogenation reaction.

The liquid stream withdrawn from liquefaction reactor effluent separator 25 through line 27 and the liquids recovered from hot liquefaction separator 33 and cold liquefaction separator 40 through lines 35 and 42 are combined following reduction of the pressure to about 100 psia or less and passed through line 54 to atmospheric fractionation unit 55. Here the feed is fractionated and an overhead fraction composed primarily of gases and naphtha constituents boiling up to about 400° F. is withdrawn through line 56. This overhead fraction is cooled in exchanger 57 and passed through line 58 to fractionator distillate drum 59 where the gases are taken off overhead through line 60. These gases may be employed as a fuel gas for the generation of process heat or used for other purposes. The liquid hydrocarbons separated from the gas are withdrawn through line 61 and a portion of this stream may be returned through line 62 to the upper part of the fractionating column. The remaining liquid may be passed through line 63 for use as feed to the solvent hydrogenation unit or taken off as a naphtha product boiling below the solvent boiling range. A sour water stream is withdrawn from the distillate drum through line 64 and passed to water cleanup facilities not shown. One or more intermediate fractions boiling within the range between about 250° F. and about 700° F. are withdrawn from the atmospheric fractionator for use as feed to the solvent hydrogenation reactor. It is generally preferred to recover a relatively light fraction composed primarily of constituents boiling below about 500° F. by means of line 65, stripper 66, vapor return line 67 and line 68 and to recover a heavier intermediate fraction composed primarily of constituents boiling below about 700° F. by means of line 69, stripper 70 vapor return line 71 and line 72. These two intermediate distillate fractions plus naphtha recovered from the overhead stream are passed through line 73 for use as liquid feed to the solvent hydrogenation unit. A portion of one or both of these streams can also be withdrawn as product through a withdrawal line not shown in the drawing if desired. The bottoms fraction from the atmospheric column, composed primarily of constituents boiling in excess of about 700° F. and including unreacted solids and residues, is withdrawn through line 74, is normally heated to a temperature of about 600° F. to about 775° F. in furnace 75, and is introduced into vacuum fractionation unit 76 through line 77. In some cases, the furnace can be omitted.

In the vacuum fractionation column, the feed is distilled under reduced pressure to permit the recovery of an overhead fraction which is withdrawn through line 78, cooled in heat exchanger 79, and then passed through line 80 into distillate drum 81. Gases and vapors are taken off through line 82, pass to the vacuum equipment, and then may be employed as fuel. Liquids are withdrawn through line 83. A heavier intermediate fraction, one composed primarily of constituents boiling below about 850° F., for example, may be recovered by means of line 87 from a pumparound circuit consisting of line 84, heat exchanger 85, line 86, and line 87. A still heavier side stream may be withdrawn through line 88, which may also include a pumparound. These three distillate fractions are passed through line 89 and combined with the distillate in line 73 for use as feed to the solvent hydrogenation unit. A part of one or all of these streams may also be taken off as product through a withdrawal line not shown in the drawing if desired. A bottoms fraction boiling in excess of about 1000° F. at atmospheric pressure and containing unreacted coal solids and residues is withdrawn from the vacuum fractionation column through line 90 and may be used for the production of additional liquid products and hydrogen or upgraded in other ways.

There are a number of alternates to the fractionation step described above which may be employed if desired. One such alternate, for example, is to pass the liquid stream from the reactor effluent separator and liquefaction separator to a centrifuge, gravity settling unit, filter or the like for the removal of unreacted coal solids from the liquids prior to fractionation. Antisolvents such as hexane, decalin, or certain petroleum hydrocarbon liquids can be added to the liquefaction products to facilitate separation of the unreacted coal and ash residues from the liquids and permit their removal from the system. Processes of this type have been described in the literature and will be familiar to those skilled in the art. The liquids remaining following the solids separation step can then be separated by fractionation into a naphtha fraction, one or more intermediate streams to be fed to the solvent hydrogenation reactor, and if desired, a heavier fraction which can be upgraded by hydrocracking and other downstream processing techniques.

Another alternate procedure which may in some cases be advantageous is to pass the liquid stream from the reactor effluent separator and liquefaction separators through a line not shown in the drawing to a coking unit associated with the process for upgrading of the liquid by thermal cracking and other reactions. The coking unit will normally include a coker fractionation tower in which the vaporized product from the coker is distilled to produce an overhead gas stream, a naphtha stream, one or more intermediate fractions useful as feed to the solvent hydrogenation stage of the process, and a heavier bottoms fraction which can be recycled for the production of additional liquids and coke. The coking unit will produce coke which can be subsequently gasified to produce hydrogen or employed for other purposes. Still other modifications in the initial handling of the liquid product from the liquefaction reaction which may be employed to produce solvent hydrogenation reactor feed and other products suitable for upgrading will suggest themselves to those skilled in the art.

As pointed out above, the feed to the solvent hydrogenation stage of the process includes liquid hydrocarbons composed primarily of constituents in the 250° F. to 700° boiling range recovered from atmospheric fractionator 55 and heavier hydrocarbons in the nominal 700° F. to 1000° F. boiling range recovered from vacuum fractionator 76. It may also include hydrocarbons of similar boiling range characteristics recovered from associated coking unit 92. The hydrocarbon feed is passed through lines 73 and 89 into line 115 and heat exchanger 116. Here the feed material passes in indirect heat exchange with hot hydrogenated product withdrawn from the solvent hydrogenation reactor through line 117. The feed is preheated from an initial temperature of from about 100° F. to about 500° F. to a final temperature of from about 600° F. to about 750° F. at a pressure from about 800 to about 3000 psig. The preheated feed is withdrawn from the exchanger through line 118 and combined with cooled vapor passed through valve 131 and line 52B. This vapor stream will include makeup introduced into the system through line 119 and compressor 120. A heat exchanger not shown in the drawing will normally be used to heat the makeup hydrogen by indirect heat exchange with the vapor in line 130 or a similar stream. Depending upon the amount of makeup hydrogen added, the hydrogen temperature, and other factors, the vapor stream containing the hydrogen may have a temperature on the order of from about 700° F. to about 900° F. The vapor stream temperature will normally be somewhat higher than that of the liquid stream in line 118 and hence addition of the vapor will further heat the liquid feed. The combined stream may then be passed through solvent hydrogenation reactor preheat furnace 121 and further heated to a temperature up to about 750° F. if desired. The amount of heat which is added in the furnace is normally relatively small and hence, depending upon the ratio in which the hot vapor and liquid feed are mixed and the temperatures of the two streams, in most cases the furnace can be omitted or bypassed. The combined feed stream heated to the solvent hydrogenation temperature is withdrawn from the furnace through line 122 and fed to the hydrogenation unit.

The solvent hydrogenation reactor shown in the drawing is a two-stage downflow unit including an initial stage 123 connected by line 124 to a second stage 125 but other type reactors can be used if desired. In this invention, it is necessary to operate the solvent hydrogenation reactor at a pressure somewhat higher than that in liquefaction reactor 23 and at a somewhat lower temperature than that in the liquefaction reactor. The temperature, pressure, and space velocity employed will depend to some extent upon the character of the feed stream employed, the hydrogenation catalyst selected for the process, and other factors. In general, temperatures within the range between about 550° F. and about 850° F., pressures between about 800 psig and about 3000 psig, and space velocities between about 0.3 and about 3 pounds of feed/hour/pound of catalyst are suitable. The makeup hydrogen rate should be sufficient to maintain the average reactor hydrogen partial pressure between about 500 and about 2000 psia. It is generally preferred to maintain a mean hydrogenation temperature within the reactor between about 675° F. and about 750° F., a pressure between about 1500 and about 2500 psig, a liquid hourly space velocity between about 1 and about 2.5 pounds of feed/hour/pound of catalyst, and a makeup hydrogen rate sufficient to maintain an average reactor hydrogen partial pressure within the range between about 900 and about 1600 psia.

Any of a variety of conventional hydrotreating catalysts may be employed in the process. Such catalysts typically comprise an alumina or silica-alumina support carrying one or more iron group metals and one or more metals from Group VI-B of the Periodic Table in the form of an oxide or sulfide. Combinations of one or more Group VI-B metal oxides or sulfides with one or more Group VIII metal oxides or sulfides are generally preferred. Representative metal combinations which may be employed in such catalyst include oxides and sulfides of cobalt-molybdenum, nickel-molybdenum-tungsten, cobalt-nickel-molybdenum, nickel-molybdenum, and the like. A suitable catalyst, for example, is a high metal content sulfided cobalt-molybdenum-alumina catalyst containing 1 to 10 weight percent of cobalt oxide and from about 5 to 40 weight percent of molybdenum oxide, preferably from 2 to 5 weight percent of the cobalt oxide and from 10 to 30 weight percent of the molybdenum oxide. Other metal oxides and sulfides in addition to those specifically referred to above, particularly the oxides or iron, nickel, chromium, tungsten and the like, can also be used. The preparation of such catalysts has been described in the literature and is well known in the art. Generally, the active metals are added to the relatively inert carrier by impregnation from aqueous solution and this is followed by drying and calcining to activate the catalyst. Carriers which may be employed include activated alumina, activated alumina-silica, zorconia, titania, bauxite, bentonite, montmorillonite, and mixtures of these and other materials. Numerous commercial hydrogenation catalysts are available from various catalyst manufacturers and can be used.

The hydrogenation reaction taking place within hydrogenation reactors 123 and 125 is an exothermic reaction in which substantial quantities of heat are liberated. The temperature in the reactor is controlled to avoid overheating and runaway reaction or undue shortening of the catalyst life by controlling the feed temperature and by means of a gaseous quench stream introduced between the two stages by means of line 126. The quantity of quench injected into the system will depend in part upon the maximum temperature to which the catalyst is to be subjected, characteristics of the feed to the reactor, the temperature of the quench stream, and other factors. In general, it is preferred to monitor the reaction temperature at various levels within each stage of the reactor by means of thermocouples or the like and regulate the amount of feed and quench admitted so that the temperature does not exceed a predetermined maximum for that particular level. By increasing the amount of feed through line 122 and the amount of quench admitted through line 126 whenever the temperature within the reactor becomes too high, the overall reaction temperature can be maintained within predetermined bounds. If the hydrogenation reaction is to be carried out in the lower part of the 555° F. to 850° F. range, as may be the case when coal liquids of relatively low specific gravity and low sulfur and nitrogen content are being hydrogenated, a somewhat greater increase in temperature may be permissible than will be the case where the hydrogenation reaction is to be carried out in the upper part of the range. Operations of the latter type are frequently used for the hydrogenation of liquid products having relatively high sulfur and nitrogen content and high specific gravity. The optimum temperature and other conditions for a particular feedstock and catalyst system can be readily determined.

The hydrogenated effluent produced in the solvent hydrogenation unit is withdrawn from the second stage 125 of the unit through line 117 at a temperature of from about 550° F. to about 850° F., preferably from about 700° F. to about 800° F., passed through heat exchanger 116 where it is cooled to a temperature on the order of from about 500° F. to about 700° F., and then passed through line 127 into solvent hydrogenation hot separator 128. An overhead gas stream is withdrawn from said separator at a temperature of from about 600° F. to about 700° F. through line 130 and thereafter recycled to the liquefaction zone through lines 130 and 150. This gas stream will consist primarily of hydrogen and normally gaseous hydrocarbons but will also contain some naphtha boiling range constituents, traces of higher hydrocarbons and contaminants such as carbon monoxide, carbon dioxide, ammonia, hydrogen sulfide, and hydrogen chloride. In the recycle loop, this gas stream is at a pressure sufficient to permit its recycle to the liquefaction stage of the operation. The gas flows through line 150 and is injected into the coal-solvent feed stream either through line 15 containing valve 22 or line 18 containing valve 19, or both.

The separator will normally be operated at pressures between about 1500 and about 2500 psig. The liquids separated from the hydrogenated effluent in hot solvent hydrogenation separator 128 are withdrawn through line 134 containing pressure reduction valve 135. The liquid stream is then passed through line 138 to solvent stripping unit 154. Here the liquids are stripped to remove gases and naphtha boiling range materials. The overhead vapor stream is taken off through line 155, cooled in heat exchanger 156 and introduced through line 157 into distillate drum 158. The off gases withdrawn through line 159 will be composed primarily of hydrogen and normally gaseous hydrocarbons but will include some normally liquid constituents in the naphtha boiling range. This stream can be used as a fuel or employed for other purposes. The liquid stream from drum 158, composed primarily of naphtha boiling range materials, is in part returned to the stripper through line 160 and in part recovered as naphtha product through line 161. A stream of sour water is also withdrawn from the distillate drum through line 162 and sent to water cleanup facilities.

One or more sidestreams boiling above the naphtha boiling range can be recovered from the liquids recovered from solvent hydrogenation if desired. If this is to be done, a preheat furnace not shown in the FIGURE will be used to heat the liquids from the hot separator to a temperature of from about 650° F. to about 800° F. and a fractionating tower equipped with suitable sidestream strippers, not shown, will be employed in lieu of the solvent stripping unit 154. Normally, however, liquids boiling above the naphtha boiling range will be recovered from the solvent stripping unit as a bottoms fraction withdrawn through line 165. A portion of this stream is recycled through line 12 to the slurry preparation zone 10 for use in preparing the coal-solvent slurry fed to the liquefaction stage of the process. The remainder of the liquids stream, assuming that the net liquefaction products have not been withdrawn from the system earlier as product from fractionators 55 and 76, can be withdrawn as coal liquids product through line 166.

Having thus described and illustrated the present invention, what is claimed is:

1. A process for the production of liquid hydrocarbons from coal or similar liquefiable carbonaceous solids which comprises contacting said carbonaceous solids with a hydrogen-donor solvent and molecular hydrogen under liquefaction conditions in a liquefaction zone to produce a liquefaction effluent; separating said liquefaction effluent into a vapor stream and a liquid stream; passing at least a portion of the liquid stream to a solvent hydrogenation unit; cooling and scrubbing the vapor stream; separating the cooled and scrubbed vapor stream into at least two portions; combining one such portion with makeup hydrogen and using the portion combined with makeup hydrogen as a treat gas in said solvent hydrogenation unit to effect hydrogenation of liquid in said solvent hydrogenation unit; using another portion of said vapor stream to effect quenching of the hydrogenation reaction; recovering a hydrogenated effluent from said solvent hydrogenation zone; separating said hydrogenated effluent into a vaporous fraction containing molecular hydrogen and a liquids fraction and recycling said vaporous fraction inluding molecular hydrogen and at least a portion of said liquids fraction to said liquefaction zone.

2. The process of claim 1 wherein that portion of the vapor stream used to effect quenching provides from about 1.5 to about 2.5 SCM of quench gas per SCM of liquids subjected to hydrogenation.

3. The process of claim 2 wherein the temperature of the quench gas is between about 100 and 200° F.

4. The process of claim 3 wherein that portion of the liquid stream subjected to hydrogenation is recycle solvent.

* * * * *